United States Patent [19]

Logan et al.

[11] 4,218,386

[45] Aug. 19, 1980

[54] HYDROLYSIS OF TRIGLYCERIDES

[75] Inventors: Ted J. Logan; David C. Underwood; Tom C. Rheinecker, all of Cincinnati, Ohio

[73] Assignee: The Procter & Gamble Company, Cincinnati, Ohio

[21] Appl. No.: 915,645

[22] Filed: Jun. 15, 1978

[51] Int. Cl.[2] ..... C11C 1/04; C11C 1/00

[52] U.S. Cl. ..... 260/415; 260/413; 562/598; 562/606; 568/852

[58] Field of Search ..... 260/413 R, 415, 416; 562/598, 606; 568/852

[56] References Cited

U.S. PATENT DOCUMENTS

| | | | |
|---|---|---|---|
| 2,378,005 | 6/1945 | Eckey | 260/410.7 |
| 2,378,006 | 6/1945 | Eckey | 260/410.7 |
| 2,458,170 | 1/1949 | Ittner | 260/415 |
| 2,801,257 | 7/1957 | Lawrence | 260/415 |
| 2,980,731 | 4/1961 | Alheritiere | 260/415 |

OTHER PUBLICATIONS

Going JAOCS 44, pp. 414A, 416A, 418A, 420A, 454A, 455A, 456A, Sep. (1967).

Meade et al., JAOCS vol. 39, pp. 1 to 6, (1962).

*Primary Examiner*—John F. Niebling

*Attorney, Agent, or Firm*—Ronald L. Hemingway; Richard C. Witte

[57] ABSTRACT

A process for hydrolyzing triglyceride having its carboxylic acid moieties containing from 6 to 26 carbon atoms involves reacting with water in the presence of low molecular weight displacing acid catalyst, strong acid catalyst and sufficient water to form water and oil phases, to produce carboxylic acids corresponding to said moieties and glycerine.

23 Claims, No Drawings

HYDROLYSIS OF TRIGLYCERIDES

BACKGROUND OF THE INVENTION

This invention relates to the field of hydrolyzing triglyceride to coproduce carboxylic acids and glycerine. More particularly, it relates to hydrolyzing triglycerides with carboxylic acid moieties containing from 6 to 26 carbon atoms.

Commercially, triglycerides have been hydrolyzed to coproduce carboxylic acids and glycerine by reacting with water under conditions of high pressure and temperature (e.g. 700 psi and 250° C.). This requires very expensive equipment.

Another commercial hydrolysis process for coproducing carboxylic acids and glycerine is known as the Twitchell process. This process involves mixing triglyceride with water and petroleum-alkyl benzene sulfonic acids and boiling with open steam for 36–48 hours. Discoloration, long reaction times and high steam consumption are principal disadvantages of Twitchell splitting.

Because of the disadvantages in the aforedescribed processes, consideration has been given to converting triglycerides to acids by an acidolysis reaction wherein a first carboxylic acid is reacted with glyceride ester of second carboxylic acids whereby second carboxylic acids are displaced from the glyceride ester by the first carboxylic acid. Articles by Meade et al (Journal of The American Oil Chemists' Society 39, 1–6, 1962) disclose such a process. In particular, the Meade et al articles disclose reacting triglycerides with acetic acid in the presence of strong acid catalyst promoted by a controlled amount of water (initial water contents of 0.5 to 8% were used with 2% being "near optimal") to produce carboxylic acids displaced from the triglycerides and triacetin. Under the best Meade et al conditions, 2 hours were required for a 65% yield of displaced acids, four hours for a 75% yield, eight hours for an 85% yield and 24 hours for a 90% yield. Moreover, Meade et al was aiming to produce triacetin rather than glycerine which is the usual triglyceride hydrolysis by-product. Furthermore, in Meade et al, the displacing acid (acetic acid) is a stoichiometric reactant (not a catalyst) consumed to produce triacetin.

It is an object of this invention to provide hydrolysis of said triglycerides wherein relatively mild conditions of temperature and pressure can be used (enabling the use of relatively inexpensive processing equipment) to coproduce high yields of displaced carboxylic acids and glycerine in relatively short times (e.g. greater than 75% conversion in less than one hour).

It is a further object of this invention to provide a process wherein displacing acid is not consumed.

DESCRIPTION OF THE INVENTION

It has been discovered that these objects and others are satisfied and various advantages are indicated below are obtained by this invention which involves an overall reaction comprising hydrolyzing triglyceride by reacting such with water in the presence of displacing acid catalyst, strong acid catalyst and sufficient water to form water and oil phases.

The overall reaction has the following reaction equation:

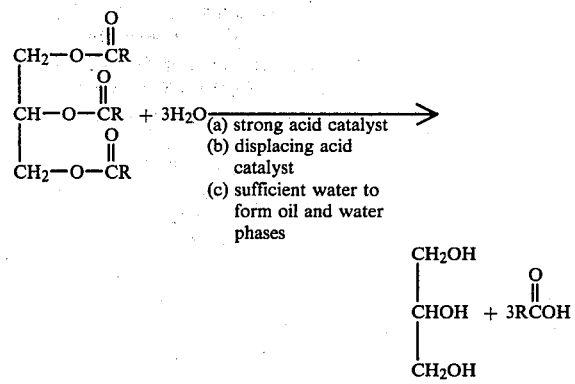

wherein R is defined as below.

The overall reaction is explained by a two step route.

The reaction of the first step involves reaction of the triglyceride with displacing acid and sometimes also with water to form water-soluble glyceride and possibly some glycerine and to produce carboxylic acids corresponding to displaced triglyceride carboxylic acid moieties. This reaction step is catalyzed by the strong acid catalyst, and the catalytic action of the strong acid catalyst is promoted by the water. The term "water-soluble glyceride" as used herein means a glyceride having a water solubility greater than the water solubility of the triglyceride reactant, e.g., a water solubility greater than 0.01% at the temperature which is being used for the reaction. The nature of the water-soluble glyceride depends on the composition of the triglyceride reactant and the specific displacing acid. For example, when the triglyceride is coconut oil and the displacing acid is acetic acid, water-soluble glyceride is produced when an average of 2 of each 3 carboxylic acid moieties are replaced by acetic. In some cases, hydrolysis can occur at one or more positions on the glycerine moiety prior to the required water-solubility being obtained; such hydrolysis can occur at a carboxylic acid group originally on the triglyceride reactant or at a carboxylic acid group on the triglyceride as a result of acidolysis. Thus, the water-soluble glyceride can comprise triglyceride, diglyceride and/or monoglyceride. What the water-soluble glyceride obtained in this step is doesn't matter. The important point is producing glyceride with enhanced water solubility compared to the original triglyceride and which is partially extracted into the water phase present due to sufficient water being utilized to form water and oil phases; this has the effect of removing glyceride product of the first reaction step thereby driving the triglyceride solubilization toward completion and of introducing the water-soluble glyceride into a milieu wherein it is easily reacted in the second reaction step to complete the conversion to acid and glycerine.

The reaction of the second step involves reaction of water-soluble glyceride with water to produce glycerine and carboxylic acids corresponding to triglyceride carboxylic acid moieties and to release any displacing acid which is attached to the glycerine moiety either during the first reaction step described above or in the course of this step. This reaction is catalyzed by the strong acid catalyst. Produced glycerine dissolves in water phase while product carboxylic acids (carboxylic acids corresponding to triglyceride carboxylic acid moieties) become part of oil phase providing for easy separation of products. This is in contrast to the Meade et al reaction where triacetin is a product since triacetin remains dissolved in the carboxylic acid product.

Both reaction steps are carried out in the same vessel or same continuous reactor. Both reaction steps can occur concurrently. The water phase functions automatically to extract water-soluble glyceride as it is produced. This extraction is preferably aided by mild agitation. As indicated above, the identity of the water-soluble glyceride is not readily defined. In addition to differences depending on the triglyceride and displacing acid, it generally consists of a plurality of different water-soluble glycerides which change over the course of the overall reaction. Thus, each position on the glycerine moiety can be hydroxyl, displacing acid or triglyceride carboxylic acid moiety at some point in the overall reaction.

We now turn to the triglyceride reactant. As indicated above, it has carboxylic acid moieties containing from 6 to 26 carbon atoms. It is aliphatic and can be saturated or unsaturated. The unsaturated moieties are usually mono-, di- or triunsaturated. Each carboxylic acid moiety in a molecule can be the same as another or different. Thus, R in the equation set forth above is aliphatic and contains 5 to 25 carbon atoms and can be the same or different within a molecule. The triglyceride reactant can be a specific triglyceride. However, the triglyceride reactant is usually a mixture of different triglycerides which are naturally occurring fats and oils such as coconut oil, lard, linseed oil, olive oil, palm oil, palm kernel oil, peanut oil, rapeseed oil, safflower oil, sesame oil, soybean oil, sunflower oil and tallow. Another suitable source of triglyceride for use herein (besides the naturally occurring fats and oils just described) is generally referred to as "acid oil" which is acidulated soapstock and is described, for example, at pages 762–765 of Bailey's Industrial Oil and Fat Products (3rd Edition) edited by Daniel Swern, published 1964 by Interscience Publishers, and at pages 356 and 357 of Volume 53 of Journal of American Oil Chemists' Society (June 1976); it consists of mono-, di- and triglycerides in admixture. When "acid oil" is reacted herein the mono- and diglycerides also react to produce carboxylic acid and glycerine. Important triglycerides are soybean oil, coconut oil, tallow and the triglyceride in acid oils such as those derived from soybean oil, palm oil, tallow etc.

We turn now to the water which is present during reaction. It has a triple role. Firstly, in the first reaction step described above involving acidolysis of triglyceride to form or participate in forming water-soluble glyceride, water serves as a promoter for the strong acid catalyst (it enhances the strong acid's catalytic activity) and thus acts to speed the overall reaction (this promoting effect is described in Meade et al cited above). Secondly, it is present in sufficient amount and serves to provide water phase which functions to extract water-soluble glyceride thereby driving the triglyceride solubilization reaction toward completion. Thirdly, it reacts to hydrolyze water-soluble glyceride to produce glycerine and carboxylic acids corresponding to carboxylic acid moieties of triglyceride reactant, and to release displacing acid to function in the triglyceride solubilizing step.

Usually, the water is used in an amount such that the weight percentage of water based on triglyceride reactant ranges from about 10% to about 100%. When more than 100% water is used, care should be taken that the strong acid catalyst is not diluted to the point where reaction rate is significantly impaired. In all cases an amount more than about 8% by weight of the reaction mixture is preferred. When "acid oil" is the source of the triglyceride, enough water is preferably used to provide hydrolysis of the mono- and di- and triglyceride constituents of the "acid oil".

The amount of water has to be enough to cause the aforementioned formation of oil and water phases. (What amount this is, is dependent on the triglyceride reactant and displacing acid catalyst.) Thus, the aforestated numerical limits are further defined and limited so as to be an amount sufficient to form oil and water phases. This formation of oil and water phases is very important in this invention because of the functions indicated above for the water phase which result in fast relatively complete reaction and formation of glycerine rather than glyceride (e.g. triacetin). In carrying out the reaction, it is preferred to choose the quantities of displacing acid catalyst, strong acid catalyst and feedstock (triglyceride source) and then to add to these sufficient water to cause formation of oil and water phases. This accommodates the fact that the interplay and nature of the chemicals make it impossible to define precisely the quantity of water needed to cause such two phase formation.

Turning now to the displacing acid catalyst, this participates in the reaction by functioning to solubilize triglyceride by reacting with it as described above but is considered a catalyst since it is not consumed in the overall reaction. While various low molecular weight carboxylic acids can be used as the displacing acid catalyst, such catalyst is practically limited to a carboxylic acid selected from the group consisting of formic acid, acetic acid and propionic acid. Acetic acid and propionic acid are preferred. The displacing acid catalyst used in one run can be more than one of those specifically set forth. Thus, the displacing acid catalyst can be, for example, some acetic acid and some propionic acid. It is used in an amount such that the weight percentage of displacing acid based on triglyceride ranges from about 10% to about 1200%, preferably, from about 50% to about 500%. If the lower limit of about 10% is not met, the reaction rate is slowed. If no displacing acid is used, the overall reaction takes days or stringent conditions of temperature and pressure as described above are necessary. If the upper limit of 1200% is exceeded, the disadvantages include the need for larger sized equipment, increased recycling needs, increased cost and increased occurrence of side reactions.

The strong acid catalyst can be, for example, any of those known for use to catalyze acidolysis reactions. The acids can be inorganic or organic, but not carboxylic. Suitable inorganic acids are those having $pK_a$ values below about 4.0 at room temperature in aqueous solution (see Moeller, *Inorganic Chemistry,* John Wiley & Sons (1952) at pages 314 and 315). Specific examples of such acids are sulfuric acid which is a preferred strong acid catalyst and hydrochloric acid, perchloric acid, nitric acid, phosphoric acid and hydrofluoric acid. Organic acids suitable for strong acid catalysts herein are noncarboxylic acids having $pK_a$ values below 2.0 in water at room temperature (see *Handbook of Chemistry and Physics,* 58th edition, Chemical Rubber Publishing Company at pages D-150 et seq.) Examples of suitable organic acids are methane sulfonic acid, naphthalene sulfonic acid, trifluoromethyl sulfonic acid and toluene sulfonic acid. Solid strong acids such as strong acid cation exchange resins of the gel or macroreticular types (e.g., Amberlite IR 120, Amberlyst 15, and XN1010, available from Rohm and Haas), and supported transition metal catalysts as described in U.S. Pat. No. 4,032,550 can also be employed. When a liquid strong acid catalyst is used, the amount of it used generally ranges from about 0.01% to about 40% by weight of triglyceride reactant and preferably ranges from about 2% to about 20% by weight of triglyceride reactant. A very preferred liquid catalyst is sulfuric acid used in an amount ranging from about 2% to about 20% by weight of triglyceride reactant. When a solid strong acid catalyst such as a strong acid cation exchange resin is used, the amount of it used ranges from about 20 to about 120 grams per mole of triglyceride reactant and preferably ranges from about 50 to about 70 grams per mole of triglyceride reactant. If the general lower limits on strong acid catalyst set forth above are not complied with, reaction rate is slowed. If the general upper limits on strong acid catalyst set forth above are exceeded, disadvantages include increased recycling needs, increased cost and increased occurrence of side reactions. Mixtures of strong acid catalysts can be used.

Generally, reaction temperatures ranging from about 50° C. to about 180° C. are utilized and very preferably the relatively mild reaction temperatures ranging from about 120° C. to about 160° C. are utilized.

The overall reaction is readily and preferably carried out at pressures of from atmospheric to 125 psig. These mild pressures can be utilized with equipment constructed in accordance with Class I metallurgy which is much less expensive than the equipment used for conventional hydrolysis.

The time for reaction is dependent on several factors. Generally, increasing amounts of displacing acid catalyst and/or strong acid catalyst and/or increasing the temperature increases reaction rate. In batch processing, relatively high yields (e.g., greater than 75% conversion in less than one hour and greater than 90% conversion in less than four hours) are readily obtained; such yields can be improved by use of multistage processing as described hereafter. Continuous processing can be used to obtain varying reaction rates, depending on the contacting pattern employed; various component addition methods such as introducing water at a plurality of locations can be employed to increase yield. Regardless of the system used, sufficient reaction time should be provided so that intermediate glycerides are substantially converted to glycerine.

Carboxylic acid product and glycerine product are readily obtained from a resultant reaction mixture as follows. The resultant reaction mixture is heterogeneous and includes oil and water phases. These phases are allowed to separate into layers, a top oil phase layer and a bottom water phase layer. The top (oil phase) layer contains carboxylic acid product (carboxylic acids corresponding to carboxylic acid moieties of the triglyceride reactant), some displacing acid and low levels of mono- or diglyceride impurity. The bottom (water phase) layer contains water, glycerine, most of the displacing acid, some mono- or diglyceride esters of displacing acid (e.g. mono- or diacetins) and any liquid strong acid catalyst. Any solid strong acid catalyst is readily separated by filtering. The carboxylic acid product is readily obtained from the oil phase layer by water washing to remove displacing acid and distilling; if the right amount of water is used, the displacing acid plus water can be recycled. Alternatively, the oil phase layer is simply distilled after neutralizing trace quantities of strong acid catalyst left in the oil phase; the displacing acid comes off first and is readily recycled. The water phase layer can be treated as follows to recover its constituents. The strong acid catalyst is neutralized. Then distillation is carried out; first water comes off, then displacing acid, then glycerine, and neutralized acid or acetins are left. When "acid oil" is the source of the triglyceride reactant, the water phase layer can similarly be separated into components as above.

The process of this invention is readily carried out by one of several different contacting patterns. Batch processes include single stage processes as well as multistage processes. A multistage batch system involves reacting triglyceride in a vessel until the rate of hydrolysis becomes slow, separating the oil phase, then adding fresh displacing acid catalyst, strong acid catalyst and water to the separated oil phase. For batch processing, suitable equipment consists of a reaction vessel or pot equipped with an agitator. For batch processing, the amounts specified are those introduced (whether initially or subsequently). For continuous processing, a suitable reactor is a tube long enough to provide satisfactory residence time with means to provide for intimate contact between the oil and water phases. Other continuous processing systems can involve a series of stirred tank reactors, plug flow reactors or other contacting patterns such as a combination of the aforementioned two types of systems or countercurrent systems. Such continuous systems can include multiple locations for introduction of components; e.g. a plug flow reactor system can include various points for water addition for driving the reaction toward completion. For a continuous process, the amounts specified are those maintained.

The limitation of sufficient water to form water and oil phases is used herein to mean sufficient water so that two liquid layers, a water phase layer and an oil phase layer, will form if there is no agitation.

The invention is illustrated by the following specific examples.

EXAMPLE I 900 grams propionic acid, 180 grams water and 12 grams sulfuric acid were placed in a 2 liter agitated reaction vessel and heated to 149° C. 300 grams soybean oil (Proctor & Gamble Company Stock No. 20600 RB) was added to the mixture. Sufficient water was present to form water and oil phases. The temperature was maintained at 140° C. and the pressure was held at 80 psig for 1 hour. At the end of the one hour period, 95% of the soybean oil was converted to corresponding fatty acids and glycerine.

EXAMPLE II 900 grams propionic acid, 180 grams water and 12 grams sulfuric acid were placed in a 2 liter agitated vessel and heated to 145° C. 300 grams coconut oil (Procter & Gamble Company Stock No. 20200RB) was added to the mixture. Sufficient water was present to form water and oil phases. The temperature was maintained at 140° C. and the pressure was held at 80 psig for 30 minutes. At the end of the 30 minute period, 78% of the coconut oil was converted to corresponding fatty acids and glycerine (i.e. 81% of the coconut oil was hydrolyzed).

EXAMPLE III 400 grams of soybean acid oil (Proctor & Gamble Company Stock No. 20683 consisting by weight of 68.3% soybean fatty acid, 16.6% triglyceride, 8.9% diglyceride, 1.2% monoglyceride and 5% phospholipids and other minor components) and 700 grams acetic acid were placed in a two liter agitated reaction vessel and heated to 157° C. under a pressure of 110 psig. 47 grams water and 11.5 grams sulfuric acid were added to the mixture of acid oil and acetic acid. The temperature was maintained between 157°–158° C. and the pressure was held at 110 psig. for 30 minutes. Analysis of a sample taken at the end of the 30 minute period showed it consisted of 92% fatty acid. Glycerine was formed in significant amount.

When in the above Examaples I and II, an equivalent amount of formic acid or acetic acid is used in place of propionic acid, substantially equal yields are obtained. When in Example I, an equivalent amount of acetic acid is substituted for one half the propionic acid, a substantially equal yield is obtained. When in Examples I and II, 12 grams of methane sulfonic acid or 60 grams Amberlyst 15 (a strong acid macroreticular cation exchange resin sold by Rohm & Haas) per mole of triglyceride is substituted for the sulfuric acid, substantially equal yields are obtained. When in Example I, an equivalent amount of rapeseed oil is substituted for the soybean oil, substantially equal yields are obtained.

The term "fatty acids" is used herein to mean carboxylic acids corresponding to carboxylic acid moieties of triglyceride reactant.

The invention may be embodied in other specific forms without departing from the essential characteristics thereof. In view of the variations that are readily understood to come within the limits of the invention, such limits are determined by the scope of the claims.

What is claimed is:

1. A process for hydrolyzing triglyceride having its carboxylic acid moieties containing from 6 to 26 carbon atoms, said process comprising reacting said triglyceride with water in the presence of displacing acid catalyst, strong acid catalyst and sufficient water to form water and oil phases to produce carboxylic acids corresponding to said moieties and glycerine; and recovering displacing acid catalyst.

2. A process as recited in claim 1, in which reaction is carried out (a) so that the displacing acid catalyst functions to solubilize triglyceride by reacting with it to form water-soluble glyceride and to produce carboxylic acids corresponding to said moieties, and (b) so that water phase functions (i) to extract said water-soluble glyceride thereby driving the triglyceride solubilization reaction toward completion and (ii) to react with water-soluble glyceride to produce glycerine and carboxylic acids corresponding to said moieties and to release displacing acid.

3. A process as recited in claim 1, in which said displacing acid catalyst is selected from the group consisting of formic acid, acetic acid and propionic acid.

4. A process as recited in claim 3, in which said displacing acid catalyst is acetic acid.

5. A process as recited in claim 3, in which said displacing acid catalyst is propionic acid.

6. A process as recited in claim 3, in which the weight percentage of displacing acid catalyst based on triglyceride ranges from about 10% to about 1200%.

7. A process as recited in claim 6, in which the weight percentage of displacing acid catalyst based on triglyceride ranges from about 50% to about 500%.

8. A process as recited in claim 1, in which said strong acid catalyst comprises liquid used in an amount ranging from about 0.01% to about 40% by weight of said triglyceride.

9. A process as recited in claim 8, in which said strong acid catalyst comprises liquid used in an amount ranging from about 2% to about 20% by weight of said triglyceride.

10. A process as recited in claim 8, in which said strong acid catalyst comprises sulfuric acid used in an amount ranging from about 2% to about 20% by weight of said triglyceride.

11. A process as recited in claim 1 in which said strong acid catalyst comprises strong acid cation exchange resin used in an amount ranging from about 20 to about 120 grams per mole of triglyceride.

12. A process as recited in claim 11, in which said strong acid catalyst comprises strong acid cation exchange resin used in an amount ranging from about 50 to about 70 grams per mole of triglyceride.

13. A process as recited in claim 1, in which the weight percentage of water based on triglyceride ranges from about 10% to about 100%.

14. A process as recited in claim 13, in which water is present in an amount more than about 8% by weight of the reaction mixture.

15. A process as recited in claim 1 in which water is present in an amount more than about 8% by weight of the reaction mixture.

16. A process as recited in claim 1, in which the weight percentage of displacing acid based on triglyceride ranges from about 10% to about 1200%, in which the strong acid catalyst comprises sulfuric acid used in an amount ranging from about 0.01% to about 40% by weight of said triglyceride and in which the weight percentage of water based on triglyceride ranges from about 10% to about 100%.

17. A process as recited in claim 16, in which the weight percentage of displacing acid based on triglyceride ranges from about 50% to about 500%, in which the strong acid catalyst comprises sulfuric acid used in an amount ranging from about 2% to about 20% by weight of said triglyceride and in which the weight percentage of water based on triglyceride ranges from about 10% to about 100%.

18. A process as recited in claim 17, in which the displacing acid is acetic acid.

19. A process as recited in claim 17, in which the displacing acid is propionic acid.

20. A process as recited in claim 2, in which sufficient reaction time is provided so that intermediate glycerides are substantially converted to glycerine.

21. A process as recited in claim 1, in which reaction temperatures ranging from about 50° C. to about 180° C. are utilized.

22. A process as recited in claim 21, in which reaction temperatures ranging from about 120° C. to about 160° C. are utilized.

23. A process for hydrolyzing triglyceride having its carboxylic acid moieties containing from 6 to 26 carbon atoms, said process comprising reacting said triglyceride with water in the presence of displacing acid catalyst, strong acid catalyst and sufficient water to produce a heterogeneous reaction mixture containing (a) displacing acid catalyst and (b) strong acid catalyst and (c) carboxylic acids corresponding to said moieties contained in oil phase and (d) glycerine contained in water phase; and recovering displacing acid catalyst from said reaction mixture.

* * * * *